US009812053B2

(12) United States Patent
Knepper et al.

(10) Patent No.: US 9,812,053 B2
(45) Date of Patent: Nov. 7, 2017

(54) REDUCING LCD POWER CONSUMPTION BY PREFERENTIALLY DIMMING INDIVIDUAL COLORS

(71) Applicant: Dell Products L.P., Round Rock, TX (US)

(72) Inventors: Lawrence E. Knepper, Leander, TX (US); Yagiz Can Yildiz, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 26 days.

(21) Appl. No.: 15/062,809

(22) Filed: Mar. 7, 2016

(65) Prior Publication Data

US 2017/0256192 A1 Sep. 7, 2017

(51) Int. Cl.

| | |
|---|---|
| ***G09G 5/10*** | (2006.01) |
| ***G09G 3/20*** | (2006.01) |
| ***G09G 3/32*** | (2016.01) |

(52) U.S. Cl.

CPC ..... *G09G 3/2003* (2013.01); *G09G 3/32* (2013.01); *G09G 2320/0626* (2013.01)

(58) Field of Classification Search

CPC ... G09G 2300/0452; G09G 2320/0247; G09G 2320/0626; G09G 2320/064; G09G 2320/0646; G09G 2320/0653; G09G 2340/06; G09G 2360/16; G09G 3/2092; G09G 3/2096; G09G 3/3426; G09G 3/3648; G09G 5/006

See application file for complete search history.

(56) References Cited

PUBLICATIONS

Tomi Koskela, "Color-Management LED Drivers Have a Bright Future" Texas Instruments Literature No. SNVA600, located at <<http://www.ti.com/lit/an/snva600/snva600.pdf>>, 10 pages, 2011.

Marty Merchant, "Tiny Universal LED Driver Can Gradate, Blink or Turn on Nine Individual LEDs with Minimal External Control" Linear Technology Design Notes, located at <<http://cds.linear.com/docs/en/design-note/dn422f.pdf>>, 2 pages, 2007.

*Primary Examiner* — Insa Sadio

(74) *Attorney, Agent, or Firm* — Baker Botts L.L.P.

(57) ABSTRACT

A display device may include a respective backlight controller for each color in a color model. A screen driver for the display device may produce a histogram of brightness values for each color in the pixel data for an image frame, and may reduce the brightness of backlighting elements of the display device for individual colors when the histogram data indicates that maximum brightness is not required. For example, based on a backlight control value or signal sent to the corresponding backlight controller, the intensity of backlighting elements for one color may be turned down, or even off, for a particular image frame while the backlighting elements for other colors remain fully powered. The screen driver may make an adjustment to the pixel data to compensate for the dimming of the backlighting elements by modifying the color values in a color lookup table.

20 Claims, 5 Drawing Sheets

REDUCING LCD POWER CONSUMPTION BY PREFERENTIALLY DIMMING INDIVIDUAL COLORS

BACKGROUND

Field of the Disclosure

This disclosure relates generally to information handling system displays and, more particularly, to reducing LCD power consumption by preferentially dimming individual colors.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Display devices, such as liquid crystal displays (LCDs) are commonly integrated within portable information handling systems configured in the form of laptop, notebook, netbook, and tablet computers, among others, and personal mobile devices, such as smart phones. Desktop or non-portable information handling systems also use display devices, which are often implemented as separate devices with input ports for graphical display signals. LCD displays consume much, if not most, of the power consumed in such information handling systems, the vast majority of which is consumed by the backlighting elements used by the LCD screens.

SUMMARY

In one aspect, a disclosed method is for reducing power consumption in a display device. The method may include receiving pixel data representing an image frame, where the pixel data encodes colors of pixels in the image frame in accordance with a color model comprising a plurality of color components. The method may also include analyzing the pixel data, including producing a respective histogram of brightness levels in the image frame for each of the color components of the color model and determining, for each color component, a respective backlight control value based on the histogram for the color component. The method may also include sending, for each color component, the backlight control value for the color component to a respective backlight controller for the color component, and controlling, for each color component, intensity for each of a plurality of illuminating elements of the display device corresponding to the color component based on the backlight control value for the color component.

In any of the disclosed embodiments, the histogram for each color component may indicate a minimum, maximum, or average brightness level for the color component in the pixel data.

In any of the disclosed embodiments, the plurality of illuminating backlight elements for each color component may include one or more strings of light-emitting diodes (LEDs) that emit light having the color of the color component.

In any of the disclosed embodiments, the plurality of illuminating backlight elements for each color component may include one or more strings of light-emitting diodes (LEDs) that backlight a subset of the image frame when displayed on the display device.

In any of the disclosed embodiments, the analyzing may further include determining a desired maximum brightness level for the color component in at least a portion of the image frame, and determining the backlight control value for the color component may be dependent on the desired maximum brightness level.

In any of the disclosed embodiments, the analyzing may further include applying a mathematical or logical function to at least a portion of the brightness values in the histogram for the color component, and determining the backlight control value for the color component may be dependent on results of the applying.

In any of the disclosed embodiments, for one of the color components, controlling the intensity for each of the plurality of illuminating elements of the display device corresponding to the color component may include reducing the brightness of the plurality of illuminating elements from a maximum brightness level. In any of the disclosed embodiments, the method may further include determining an adjustment to be made to at least a portion of the color values in a color lookup table to compensate for reducing the brightness, and applying the adjustment to the color values in the color lookup table.

Other disclosed aspects include an article of manufacture including a non-transitory computer-readable medium storing instructions executable by a processor of a display device, and a screen driver, including a processor having access to a memory that stores instructions executable by the processor.

BRIEF DESCRIPTION OF THE DRAWINGS

For a more complete understanding of the present invention and its features and advantages, reference is now made to the following description, taken in conjunction with the accompanying drawings, in which.

DESCRIPTION OF PARTICULAR EMBODIMENT(S)

Figure 1:
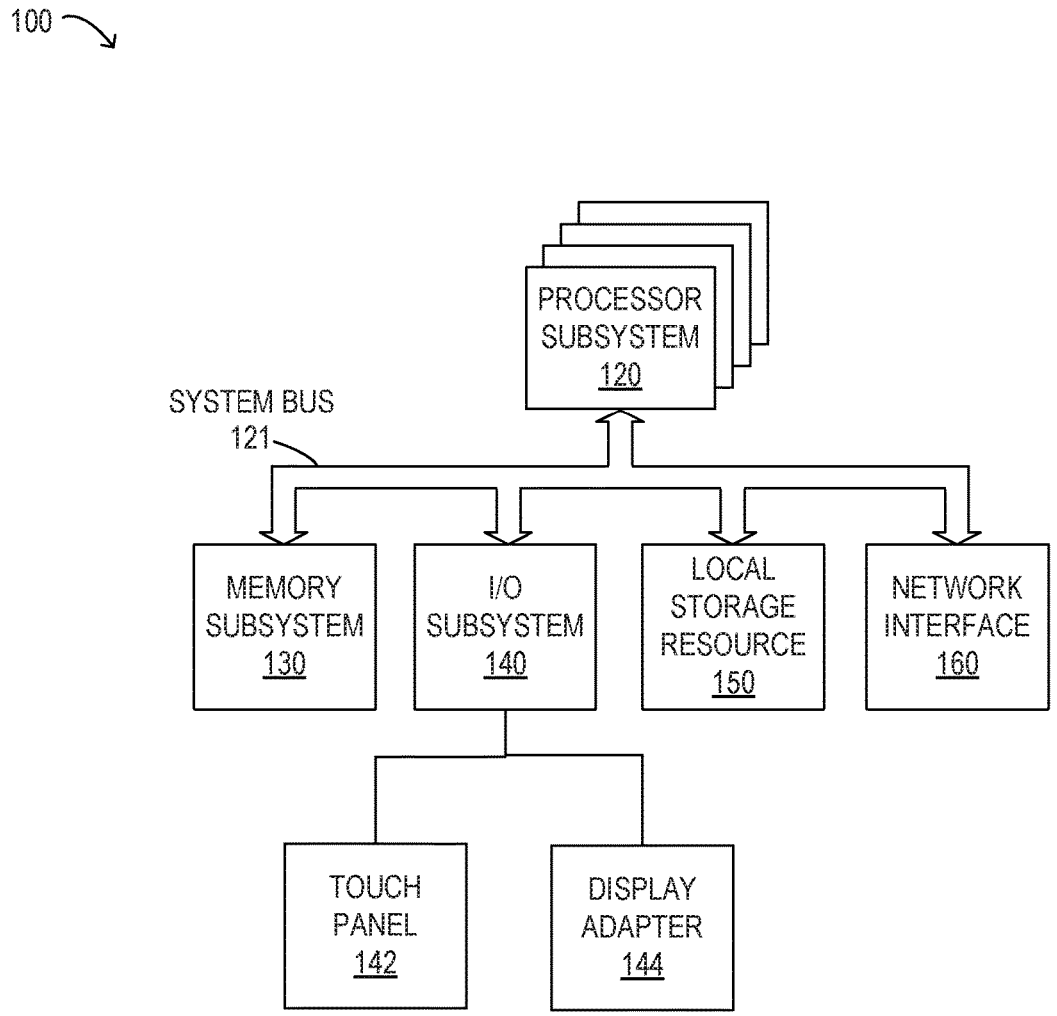
FIG. 1 is a block diagram of selected elements of an embodiment of an information handling system.

In the following description, details are set forth by way of example to facilitate discussion of the disclosed subject matter. It should be apparent to a person of ordinary skill in the field, however, that the disclosed embodiments are exemplary and not exhaustive of all possible embodiments.

As used herein, a hyphenated form of a reference numeral refers to a specific instance of an element and the unhyphenated form of the reference numeral refers to the collective or generic element. Thus, for example, widget "72-1" refers to an instance of a widget class, which may be referred to collectively as widgets "72" and any one of which may be referred to generically as a widget "72".

For the purposes of this disclosure, an information handling system may include an instrumentality or aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a personal computer, a PDA, a consumer electronic device, a network storage device, or another suitable device and may vary in size, shape, performance, functionality, and price. The information handling system may include memory, one or more processing resources such as a central processing unit (CPU) or hardware or software control logic. Additional components or the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

For the purposes of this disclosure, computer-readable media may include an instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory (SSD); as well as communications media such wires, optical fibers, microwaves, radio waves, and other electromagnetic and/or optical carriers; and/or any combination of the foregoing.

As more and larger displays become more widespread with certain information handling systems, including portable information handling systems, the ability to reduce the amount of power consumed by backlighting the displays becomes increasingly desirable. As will be described in further detail, the inventors of the present disclosure have developed methods and systems disclosed herein for reducing power consumption in a display device by preferentially dimming individual colors. In at least some embodiments of the present disclosure, a screen driver may produce a histogram of brightness values for each color in the pixel data for an image frame, and may reduce the brightness of backlighting elements for individual colors when the histogram data indicates that maximum brightness is not required for those colors. For example, an image frame representing an ocean scene may include virtually no red content, but may include green or blue portions with maximum intensity. In this example, the intensity of the backlighting elements for the red content (e.g., red LEDs) may be turned down, or even off, for the image frame, saving a substantial amount of power, while the green and blue backlighting elements may remain fully powered. In at least some embodiments, the screen driver may make an adjustment to the pixel data to compensate for the dimming of the backlighting elements by modifying the color values in a color lookup table.

Particular embodiments are best understood by reference to FIGS. 1, 2, 3, 4, and 5 wherein like numbers are used to indicate like and corresponding parts.

Turning now to the drawings, FIG. 1 illustrates a block diagram depicting selected elements of an embodiment of information handling system 100. As described herein, information handling system 100 may represent a personal computing device, such as a personal computer system, a desktop computer, a laptop computer, a notebook computer, etc., operated by a user. In various embodiments, information handling system 100 may be operated by the user using a keyboard and a mouse (not shown).

As shown in FIG. 1, components of information handling system 100 may include, but are not limited to, processor subsystem 120, which may comprise one or more processors, and system bus 121 that communicatively couples various system components to processor subsystem 120 including, for example, a memory subsystem 130, an I/O subsystem 140, local storage resource 150, and a network interface 160. System bus 121 may represent a variety of suitable types of bus structures, e.g., a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, Peripheral Component Interconnect (PCI) bus, PCI-Express bus, HyperTransport (HT) bus, and Video Electronics Standards Association (VESA) local bus.

In FIG. 1, network interface 160 may be a suitable system, apparatus, or device operable to serve as an interface between information handling system 100 and a network (not shown). Network interface 160 may enable information handling system 100 to communicate over the network using a suitable transmission protocol and/or standard, including, but not limited to, transmission protocols and/or standards enumerated below with respect to the discussion of network 155. In some embodiments, network interface 160 may be communicatively coupled via the network to a network storage resource (not shown). The network coupled to network interface 160 may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, the Internet or another appropriate architecture or system that facilitates the communication of signals, data and/or messages (generally referred to as data). The network coupled to network interface 160 may transmit data using a desired storage and/or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), and/or any combination thereof. The network coupled to network interface 160 and/or various components associated therewith may be implemented using hardware, software, or any combination thereof.

As depicted in FIG. 1, processor subsystem 120 may comprise a system, device, or apparatus operable to interpret and/or execute program instructions and/or process data, and may include a microprocessor, microcontroller, digital signal processor (DSP), application specific integrated circuit (ASIC), or another digital or analog circuitry configured to interpret and/or execute program instructions and/or process data. In some embodiments, processor subsystem 120 may interpret and/or execute program instructions and/or process data stored locally (e.g., in memory subsystem 130). In the same or alternative embodiments, processor subsystem 120 may interpret and/or execute program instructions and/or process data stored remotely (e.g., in a network storage resource, not shown).

Also in FIG. 1, memory subsystem 130 may comprise a system, device, or apparatus operable to retain and/or retrieve program instructions and/or data for a period of time (e.g., computer-readable media). Memory subsystem 130 may comprise random access memory (RAM), electrically erasable programmable read-only memory (EEPROM), a PCMCIA card, flash memory, magnetic storage, opto-magnetic storage, and/or a suitable selection and/or array of volatile or non-volatile memory that retains data after power to its associated information handling system, such as system 100, is powered down. Local storage resource 150 may comprise computer-readable media (e.g., hard disk drive, floppy disk drive, CD-ROM, and/or other type of rotating storage media, flash memory, EEPROM, and/or another type of solid state storage media) and may be generally operable to store instructions and/or data. In system 100, I/O subsystem 140 may comprise a system, device, or apparatus generally operable to receive and/or transmit data to/from/within information handling system 100. I/O subsystem 140 may represent, for example, a variety of communication interfaces, graphics interfaces, video interfaces, user input interfaces, and/or peripheral interfaces. As shown, I/O subsystem 140 may comprise touch panel 142 and display adapter 144. Touch panel 142 may include circuitry for enabling touch functionality in conjunction with a display device that is driven by display adapter 144. It is noted that when information handling system 100 is a laptop computer with an integrated display device, display adapter 144 may provide connectivity for an external display, such as display device 200 (see FIG. 2).

As will be described in further detail herein, information handling system 100 and/or display adapter 144 may support operation with a display device that is enabled to reduce power consumption by preferentially dimming individual colors.

Figure 2:
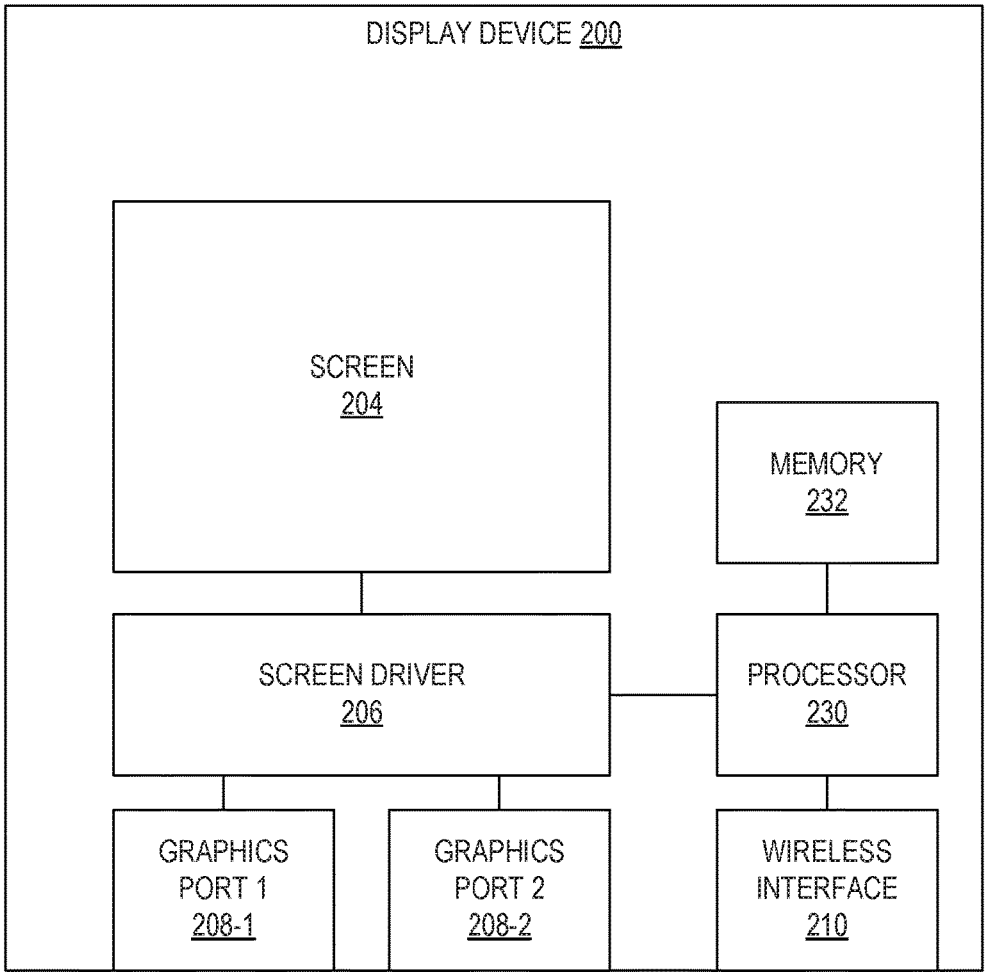
FIG. 2 is a block diagram of selected elements of an embodiment of a display device.

Turning now to FIG. 2, a block diagram of selected elements of an embodiment of display device 200 is illustrated. In some embodiments, display device 200 may represent a stand-alone device that may be coupled to one or more information handling systems to output display data. In certain embodiments, display device 200 may be a display integrated within a laptop or a notebook. As used herein, the term "output" with regard to display data shall refer to display of optical elements (i.e., pixels) representing the display data on a screen and may represent a continuing process where the display data is constantly updated at a given refresh rate.

As shown in FIG. 2, display device 200 accordingly includes screen 204 and screen driver 206. Screen 204 may represent any of a variety of display screens and may be implemented in a fixed resolution corresponding to a number of pixels included within screen 204. Screen driver 206 may include processing capability to receive display data and generate corresponding control signals to drive screen 204. In some embodiments, screen 204 may include an actively illuminated element, such as a backlight (not shown). Screen 204 may be implemented using various types of display technology, including, but not limited to, light-emitting diodes (LED), liquid crystal displays (LCD), plasma displays, etc.

In FIG. 2, display device 200 is shown including two graphics ports 208, namely graphics port 1 208-1 and graphics port 2 208-2. The two graphics ports 208 may represent wired interfaces for receiving display data from an information handling system (e.g., via display adapter 144, see FIG. 1) and may be different types of ports or two instances of the same type of port. Graphics ports 208 may be analog ports (e.g., video graphics adapters (VGA), among others) or digital ports (e.g., digital video interface (DVI), high-definition multimedia interface (HDMI), among others). Particularly when graphics ports 208 are digital ports, graphics ports 208 may support bidirectional communication with an information handling system to both receive display data and to send/receive other information, such as display control information, including extended display identification data (EDID).

In display device 200, processor 230 and memory 232 represent data processing functionality where memory 232 may store data and/or instructions executable by processor 230. Processor 230 may also communicate with screen driver 206, which may also include processing functionality (not shown). In certain embodiments, processor 230 may be coupled to graphics ports 208, either via screen driver 206 as shown in FIG. 2 and/or directly. Also shown in display device 200 is wireless interface 210, which may represent a suitable wireless interface for receiving display data, for example, from a wireless transceiver of a portable information handling system (not shown).

In operation, display device 200 may be set up to receive display data from an information handling system, such as information handling system 100 (see FIG. 1) via graphics ports 208. In operation, display device 200 may also be set up to receive display data from a portable information handling system (not shown) via wireless interface 210.

Figure 3:
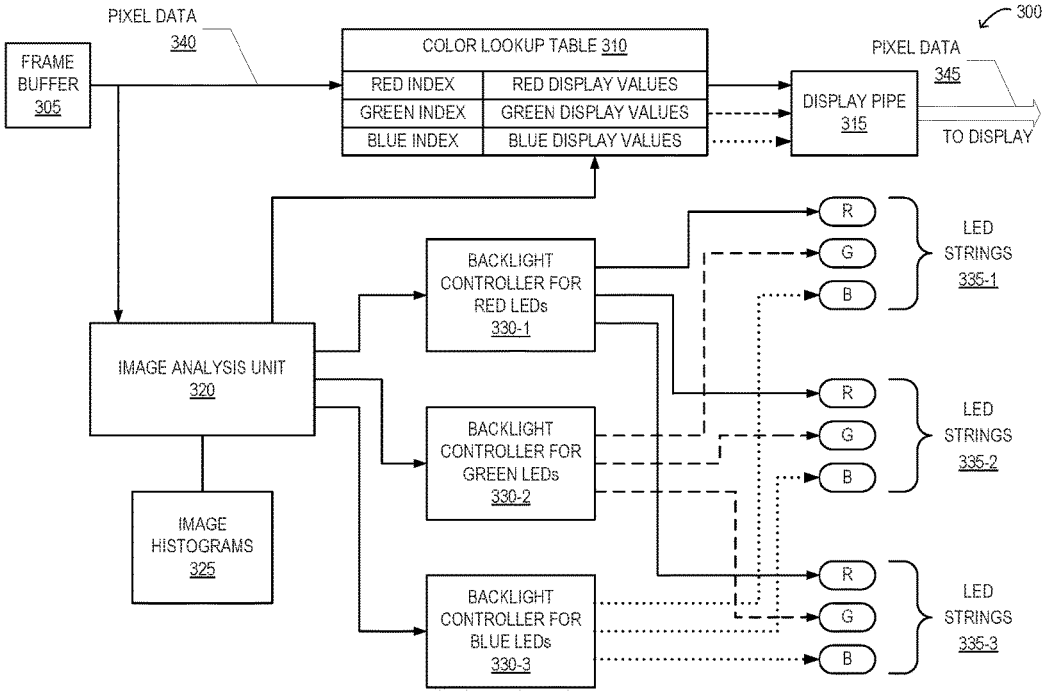
FIG. 3 is a block diagram of selected elements of an embodiment of a screen driver for a display device.

Referring now to FIG. 3, a block diagram of selected elements of an embodiment of a screen driver 300 for a display device (such as display device 200, see FIG. 2) is illustrated. Screen driver 300 may be an embodiment of screen driver 206 (see FIG. 2). As shown, screen driver 300 includes an image analysis unit 320, multiple image histograms 325, a color lookup table 310, a display pipe 315, and multiple backlight controllers 330. In one embodiment, screen driver 300 may include a frame buffer 305, from which pixel data 340 is obtained. In another embodiment, frame buffer 305 may be a component of display device 200 that is outside of screen driver 300. In one embodiment, image histograms 325 and/or color lookup table 310 may be implemented in an embodiment of a memory 232 (see FIG. 2). In various embodiments, image analysis unit 320 may be implemented by a CPU or GPU that executes instructions to perform the operations of image analysis unit 320 described herein. For example, image analysis unit 320 may include a processor 230 (see FIG. 2) that executes instructions resident within memory 232 (see FIG. 2).

In operation of display device 200, executable code (i.e., processor-executable instructions) may be executed by screen driver 300, by screen driver 206 or processor 230 on display device 200 (see FIG. 2), by information handling system 100 (see FIG. 1), and/or by a portable information handling system (not shown) to reduce the power consumption of display device 200. For example, a user may connect a personal computer (represented by information handling system 100) to display device 200 or may also establish a wireless link with a tablet computer or other portable information handling system to display device 200. Display device 200 may then begin to receive display data from the information handling system. In one embodiment, the display data may be directed to frame buffer 305, from which it may be accessed by various components of screen driver 300 as pixel data 340. In one embodiment, frame buffer 305 may be implemented within a video RAM in the information handling system (not shown). In another embodiment, frame buffer 305 may store data representing a single image frame that was obtained from a video RAM in the information handling system (not shown).

In the example embodiment illustrated in FIG. 3, rather than pixel data 340 in frame buffer 305 merely being provided to the display screen (such as screen 204, see FIG. 2) in a scanned fashion (e.g., by rows and columns), it may first be analyzed to determine the potential for reducing power consumption on a per-color basis. In operation, image analysis unit 320 may analyze pixel data 340 to determine the intensity and brightness of an image frame represented by pixel data 340. More specifically, the image analysis unit may perform an image analysis on each image frame stored in, or obtained from, a video RAM in the information handling system (not shown). As a result of this analysis, image analysis unit 320 may generate, on a frame-by-frame basis, a respective histogram for each of the colors of the color model. Each histogram may indicate the maximum, minimum, and/or average brightness level required for displaying the one of the colors. For example, in an embodiment in which the pixel data includes color information that is encoded according to a Red-Green-Blue (RGB) color model, image analysis unit 320 may generate one histogram based on the intensity values (luminance) for the red components of the pixel data, another histogram based on the intensity values (luminance) for the green components of the pixel data, and yet another histogram based on the intensity values (luminance) for the blue components of the pixel data. In at least some embodiments, image analysis unit 320 may generate multiple histograms for an image frame (e.g., one for each color in the color model) in parallel. In some embodiments, image analysis unit 320 may store the resulting histograms, at least temporarily, as image histograms 325.

In operation, image analysis unit 320 may, based on the histogram information, determine a desired maximum brightness level for each color component, and may provide information to the backlight controllers 330 for each color component to achieve that maximum brightness level. In some embodiments, image analysis unit 320 may provide a respective backlight control value to each of the backlight controllers 330 that controls the brightness of the backlight light-emitting diodes (LEDs) controlled by that backlight controller. For example, if the desired maximum brightness level for a given color component is less than the maximum brightness of the LEDs of the given color, the backlight control value provided by image analysis unit 320 to the backlight controllers 330 for those LEDs may cause those LEDs to be dimmed to the desired maximum brightness level.

Image analysis unit 320 may use different approaches to determining the desired maximum brightness level for each color component, in different embodiments. For example, in one embodiment, the desired maximum brightness level for a given color may be equal to the maximum brightness level for that color that is observed in pixel data 340. Dimming the backlight LEDs of the given color to the desired maximum brightness level may reduce the power consumed by display device 200. In another embodiment, a greater reduction in power consumption may be achieved (with no visible artifacts in the image) by determining a desired maximum brightness level for a given color that is less than the maximum observed brightness level for that color. For example, the desired maximum brightness level for a given color may be calculated as a predetermined percentage of the observed maximum brightness level for that color in pixel data 340. In another example, depending on the shape of the corresponding histogram, the maximum observed brightness level for a given color might be an outlier that is so far away from the rest of the histogram data for the given color that it may be ignored when determining the desired maximum brightness level without any discernable effect on the image as displayed. In another embodiment, determining the desired maximum brightness level for a given color may be dependent on the average brightness level represented in the pixel data and/or the distribution of the brightness levels represented in the pixel data. For example, the desired maximum brightness level may be a function of the average brightness level represented in the histogram for the given color, or may be equal to a value that is one standard deviation away from the maximum brightness level for the given color in the histogram for the given color. In one embodiment, the desired maximum brightness level may be determined based on the brightness levels and shape of the histogram at the tail of the distribution of brightness values, which may indicate the point at which the greatest reduction in power may be achieved without the image quality suffering.

As noted above, in the display devices described herein, the backlight LEDs of the display device (such as display device 200, see FIG. 2) may be controlled individually based on the histogram results for each color of the color model. In some embodiments, the image histograms 325 may be delivered to the appropriate backlight controllers 330, and the backlight controllers may determine the desired maximum brightness levels for each color based on the histogram data. In such embodiments, each of the backlight controllers 330 may determine a respective backlight control value to use in order to dim the backlight LEDs of one of the colors. In other words, in different embodiments, backlight control values for each backlight controller 330 may be generated by image analysis unit 320 or by the backlight controllers themselves based on the respective image histograms 325 for each color. In operation, each of the three backlight controllers illustrated in FIG. 3 as backlight controller 330-1 (for red LEDs), backlight controller 330-2 (for green LEDs), and backlight controller 330-3 (for blue LEDs) may adjust the brightness of one or more strings of LEDs of the corresponding color according to the desired maximum brightness level specified by the image analysis.

Unlike with existing Content Adaptive Backlight Controller (CABC) technology, which dims all of the LCD backlighting elements of all colors for dark images, the power-saving mechanisms implemented by screen driver 300 may be used to adjust the brightness of individual LEDs according to the color of the image displayed. In other words, in at least some embodiments, color content awareness may be incorporated into the backlight controllers 330 of screen driver 300 to cause the dimming of individual primary color LEDs if the maximum brightness of those LEDs is not necessary for the display of a given image frame, regardless of the general darkness or brightness of the given image frame. In at least some embodiments, the mechanisms described herein may detect the required brightness for each of the colors represented in the color model for the pixel data and may control the backlighting elements corresponding to those colors accordingly. For example, in an embodiment in which the pixel data includes color information that is encoded according to a Red-Green-Blue (RGB) color model, the red, green, and blue LED backlights may be individually adjusted to respective (potentially different) brightness levels based on the analysis performed by image analysis unit 320. In one example, if an ocean scene is to be displayed on a computer, the main colors represented in the pixel data for many of the image frames may include different shades of blue. In this example, turning the intensity of the red and/or green backlight LEDs down (or even turning those backlight LEDs off) while displaying these image frames may save a significant amount of power without affecting the image quality.

In some embodiments, a display device (such as display device 200, see FIG. 2) may include strings of illuminating elements of particular colors on the edge of the backlight. For example, the display device may include one or more strings of red LEDs, one or more strings of green LEDs, and one or more strings of blue LEDs on the edge of the backlight. In at least some embodiments, a different group of LED strings may illuminate each portion of the display screen (such as screen 204, see FIG. 2). For example, the embodiment illustrated in FIG. 3 includes three such groups of LED strings (shown as 335-1, 335-2, 335-3), each of which includes one or more strings of red LEDs, one or more strings of green LEDs, and one or more strings of blue LEDs. In operation, backlight controller 330-1 may control the brightness of one or more strings of red backlight LEDs in each grouping of LED strings 335. For example, backlight controller 330-1 may control the brightness of a string of red backlight LEDs within LED strings 335-1, a string of red backlight LEDs within LED strings 335-2, and a string of red backlight LEDs within LED strings 335-3. Similarly, backlight controller 330-2 may control the brightness of a string of green backlight LEDs within LED strings 335-1, a string of green backlight LEDs within LED strings 335-2, and a string of green backlight LEDs within LED strings 335-3, and backlight controller 330-3 may control the brightness of a string of blue backlight LEDs within LED strings 335-1, a string of blue backlight LEDs within LED strings 335-2, and a string of blue backlight LEDs within LED strings 335-3.

In some embodiments, the backlight of a display device (such as display device 200, see FIG. 2) may be implemented as a light guide pipe through which the light from illuminating elements (e.g., red, green, and blue LEDs) on the edge propagate and are scattered uniformly throughout the display (e.g., throughout an LCD matrix). In one embodiment, display pipe 315 may be a collection of row and column registers from which pixel data 345 (e.g., pixel data resulting from the mapping of pixel data 340 using the display values in color lookup table 310) is scanned out to an LCD display. In at least some embodiments, red, green, and blue LEDs may be packed densely enough and the light they emit may be scattered enough so that the resulting backlight (absent the color-content-based brightness adjustments described herein) is white. Controlling the red, green, and blue LEDs separately, as described herein, may change the hue of the backlight on a frame-by-frame basis, depending on whether or not the red, green, and/or blue LEDs are dimmed for each frame. In at least some embodiments, in order to compensate for such a change in hue of the backlight, the results of the image analysis performed by image analysis unit 320 may also be used to adjust the color values (sometimes referred to herein as "display values") for individual colors within a color lookup table, such as color lookup table 310.

In an information handling system (such as information handling system 100, see FIG. 1), one or more color lookup tables, some of which may be available for general application use, may be used to convert a logical/image color representation of each pixel into a real/hardware color representation that feeds into a display output link (e.g., the physical link from display pipe 315 to an LCD display). In one embodiment, a color lookup table implemented in the system (e.g., in the GPU) may be used by the operating system to map colors represented in an application using one color model to a color model implemented in a display device (such as display device 200, see FIG. 2). In another embodiment, a color lookup table implemented in the system may be used by the operating system to map colors represented in the operating system itself using one color model to a color model implemented in a display device. For example, a color lookup table may be used by an application or operating system to compensate for gamma in the display device. In another example, a color lookup table may be used by an application or operating system to achieve a certain color gamut. In yet another example, a color lookup table may be used to map color values that are generated by an application for an image frame to be displayed on a screen (such as screen 204, see FIG. 2) to other color values when the image frame is to be printed. In this example, when the image frame is printed, the colors in the image frame may look the same as those displayed on the screen.

In one embodiment, one such color lookup table 310 includes red display values, green display values, and blue display values for each of multiple index values. In at least some embodiments, at least some of the individual color values in one or more such color lookup tables may be updated to compensate for any adjustments made to the intensity of the red, green, and/or blue backlight LEDs by the backlight controllers 330, as described above. For example, if the red backlight LEDs are dimmed by backlight controller 330-1, the intensity of the red display values in color lookup table 310 may be increased to compensate for the change in the backlighting. In some embodiments, updating the display values for a given color in a color lookup table may include applying a linear function to the display values, based on the amount or percentage by which the brightness level of the backlight LEDs for the given color was reduced. For example, if the backlight intensity of the red LEDs is reduced by 20% by the backlight controller 330-1, the intensity of the red display values in color lookup table 310 may be increased by 20%. In one embodiment, image analysis unit 320 may determine the amount by which the color values in color lookup table 310 are to be adjusted based on the image analysis and resulting image histograms 325, and may apply those adjustments to the color values in color lookup table 310. In another embodiment, image analysis unit 320 may provide the image histograms 325 to color lookup table 310 (or to other logic associated with color lookup table 310). In such embodiments, color lookup table 310 may determine the amount by which the color values are to be adjusted, based on the image histograms 325, and may update itself accordingly. By adjusting the color values in color lookup table 310, the pixel value that is ultimately displayed on the screen (including its intensity) may be the same as it would have been had the backlighting not been adjusted using the mechanisms described herein. In at least some embodiments, power reductions that are based on the color content of individual image frames may be achieved without distorting images displayed on the screen image at all. In addition, by applying these backlight power reduction techniques on a per-color basis, there may be a substantially higher percentage of image frames for which the power can be reduced than in systems that apply a greyscale-based approach to backlight power reduction.

In some embodiments, the backlight power reduction techniques described herein may be applied to each image frame as a whole. In such embodiments, the same histograms and/or backlight control values generated by image analysis unit 320 may be applied to dim the LEDs in all of the strings of LEDs of a given color, and the same compensating adjustments (if any) may be made to all of the display values for the same color in color lookup table 310. In other embodiments, the backlight power reduction techniques described herein may be applied independently to different portions of each image frame. In such embodiments, image analysis unit 320 may perform a separate image analysis on each sub-image, and may generate respective histograms (e.g., one for each color) for each sub-image, based on the brightness levels in that sub-image. In addition, different backlight controllers 330 of screen driver 300 may use that per-sub-image information to control the intensity of different collections of backlight LEDs that illuminate each sub-image when displayed on display device 200. In one example, different collections of LED strings 335 may be used to backlight each of four strips into which the display is divided, such that each strip includes 25% of the display. In this example, each image frame to be displayed may also be divided into four strips, each of which is to be backlit by one of the collections of LED strings 335, when displayed. The brightness of the red, green, and blue LEDs in each collection of LED strings 335 may then be individually controlled by a corresponding backlight controller 335 based on the histogram information for the sub-image that is to be backlit by those LED strings. In at least some embodiments, detecting and controlling the brightness levels for individual colors of an image frame in different portions of the display may result in greater power savings than applying these color-dependent backlight power reduction techniques uniformly across an image frame. For example, LEDs of a given color may be dimmed in one portion of an image frame even if they cannot be dimmed across the entire image frame.

Figure 4:
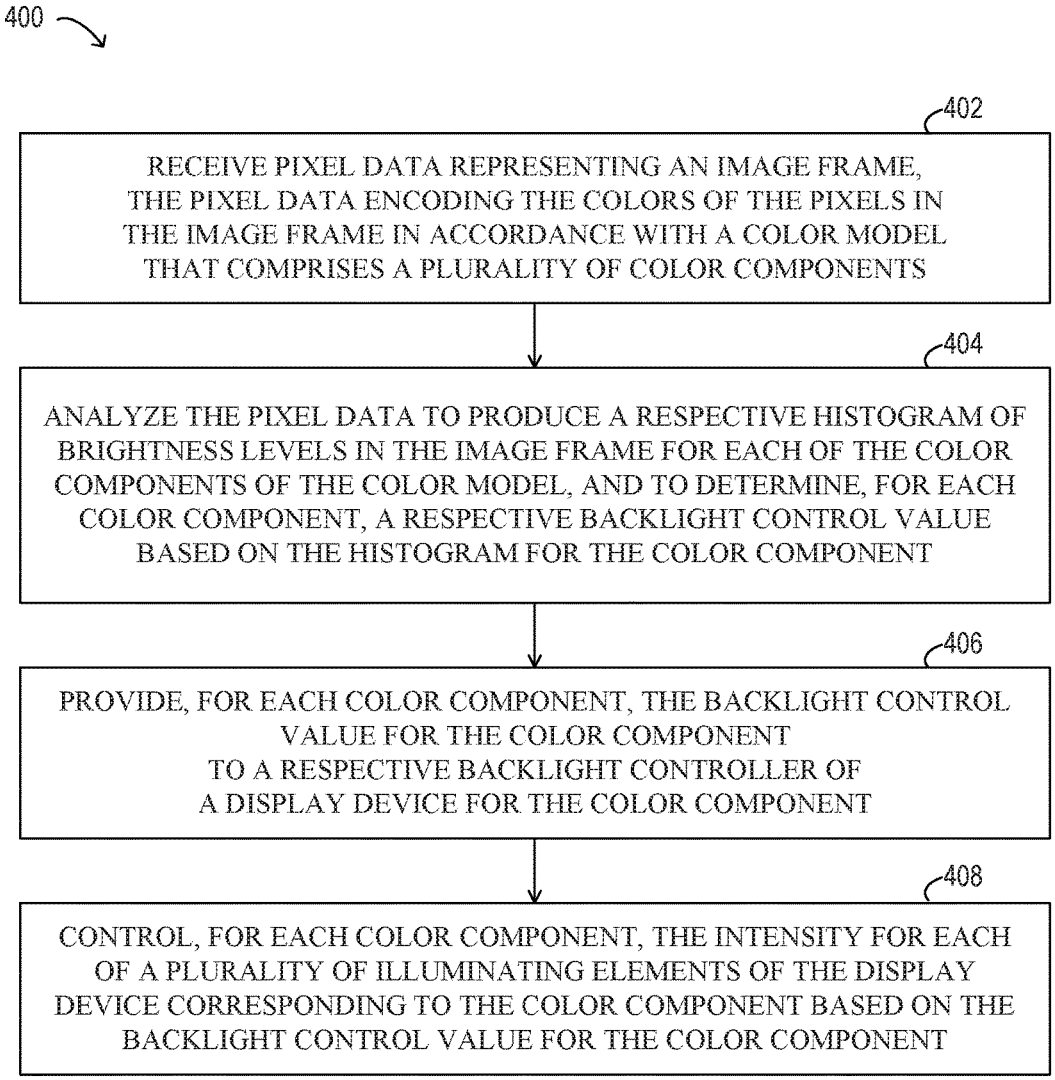
FIG. 4 is flowchart depicting selected elements of an embodiment of a method for reducing power consumption in a display device.

Referring now to FIG. 4, a block diagram of selected elements of an embodiment of method 400 for reducing power consumption in a display device, as described herein, is depicted in flowchart form. In various embodiments, method 400 is performed by display device 200 (see FIG. 2). It is noted that certain operations described in method 400 may be optional or may be rearranged in different embodiments.

In FIG. 4, method 400 may begin by receiving (operation 402) pixel data representing an image frame. The pixel data may encode the colors of the pixels in the image frame in accordance with a color model that comprises a plurality of color components. In one embodiment, the pixel data may include color information that is encoded according to a Red-Green-Blue (RGB) color model. The pixel data may be analyzed (operation 404) to produce a respective histogram of brightness levels in the image frame for each of the color components of the color model, and to determine, for each color component, a respective backlight control value based on the histogram for the color component. In various embodiments, each histogram may indicate one or more of: the minimum brightness level, the maximum brightness level, or the average brightness level for a given color in the image frame. In one embodiment, the analysis may include determining a desired maximum brightness level for the color component in at least a portion of the image frame, and the backlight control value may be dependent on this desired maximum brightness level. In another embodiment, the analysis may include applying a mathematical or logical function to at least a portion of the brightness values in the histogram for the color component, and the backlight control value may be dependent on the results of applying the mathematical or logical function to the brightness values. In some embodiments, the backlight control value may control the amount by which the intensity of the backlighting of the image frame by illuminating elements of a particular color is reduced from its maximum intensity level.

In method 400, the backlight control value for each color component may be provided (operation 406) to a respective backlight controller of a display device for the color component. The intensity for each of a plurality of illuminating elements of the display device corresponding to each color component may be controlled (operation 408) based on the backlight control value for the color component. For example, in one embodiment, a first backlight controller 330-1 may control the intensity for red LEDs based on a backlight control value that was determined based on a histogram of brightness levels for the red components of the pixel data in the image frame. In this example, a second backlight controller 330-2 may control the intensity for green LEDs based on a backlight control value that was determined based on a histogram of brightness levels for the green components of the pixel data in the image frame, and a third backlight controller 330-3 may control the intensity for blue LEDs based on a backlight control value that was determined based on a histogram of brightness levels for the blue components of the pixel data in the image frame.

Figure 5:
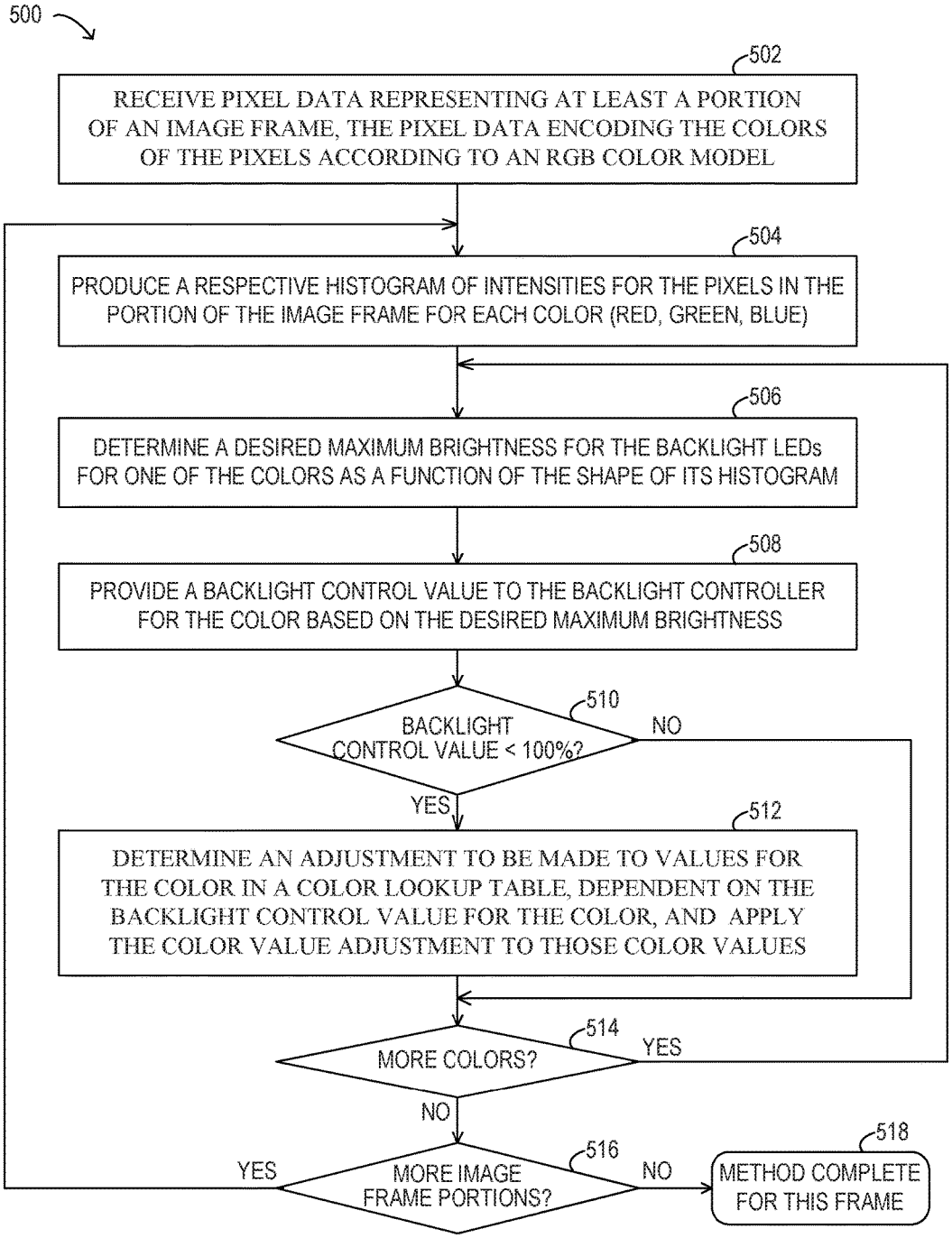
FIG. 5 is flowchart depicting selected elements of an embodiment of a method for utilizing image data for individual colors to reduce power in a display device.

Referring now to FIG. 5, a block diagram of selected elements of an embodiment of method 500 for utilizing image data for individual colors to reduce power in a display device, as described herein, is depicted in flowchart form. In various embodiments, method 500 is performed by display device 200 (see FIG. 2), which may include a screen driver 206 (see FIG. 2) or a screen driver 300 (see FIG. 3). It is noted that certain operations described in method 500 may be optional or may be rearranged in different embodiments.

In FIG. 5, method 500 may begin by receiving (operation 502) pixel data representing at least a portion of an image frame. The pixel data may encode the colors of the pixels in the image frame in accordance with a Red-Green-Blue (RGB) color model. In one embodiment, the pixel data may be received by a screen driver 206 over a graphics port 208 or wireless interface 210 (see FIG. 2). In another embodiment, the pixel data may be received by a screen driver 300 (see FIG. 3). For example, screen driver 300 may obtain pixel data 340 from a frame buffer 305. A respective histogram may be produced (operation 504) for each color (red, green, and blue) representing the intensities of the color for the pixels in the portion of the image frame.

A desired maximum brightness level may be determined (operation 506) for the backlight LEDs for a given one of the colors as a function of the shape of its histogram. In one embodiment, the desired maximum brightness may correspond to the maximum brightness level for the given color in the histogram. In another embodiment, the desired maximum brightness level may be calculated as a function of the histogram values. For example, the desired maximum brightness level may correspond to the average of the histogram values. In another example, the desired maximum brightness level may be calculated as a predetermined percentage of the maximum brightness level for the given color in the histogram. In yet another example, the desired maximum brightness level may correspond to a brightness level that is one standard deviation away from the maximum brightness level for the color in the histogram. A backlight control value may be provided (operation 508) to the backlight controller for the color. In at least some embodiments, the backlight control value may be based on the desired maximum brightness. For example, the backlight control value may be calculated such that its application to the corresponding backlight controller causes the brightness introduced by backlight LEDs of the given color to match the desired maximum brightness for the given color in the target portion of the image frame.

In method 500, if (at 510) the backlight control value is such that the brightness introduced by backlight LEDs of the given color will be less than the maximum brightness that can be introduced by the backlight LEDs, an adjustment to be made to at least a portion of the values for the color in a color lookup table may be determined (operation 512), and the adjustment may be applied to those color values in the color lookup table. In at least some embodiments, the adjustment may be dependent on the backlight control value for the color. For example, the amount of the adjustment may be calculated such that it compensates for a reduction in the intensity of the backlight LEDs of the given color caused by the application of the backlight control value for the given color. In embodiments in which different backlight controllers control the brightness of LEDs that backlight different portions of the image frame, only the color values in the color lookup table corresponding to pixels in the portion of the image frame that is backlit by the LEDs controlled by a given backlight controller (the backlight controller to which a given backlight control value is applied) may be modified by operation 512. In other embodiments, an adjustment may be made to color values in the color lookup table in response to determining that the brightness introduced by backlight LEDs of the given color will be reduced by more than a predetermined amount or by more than a predetermined percentage of their maximum brightness level. In method 500, if (at 510) the backlight control value indicates that the brightness introduced by backlight LEDs of the given color will be equal to the maximum brightness, operation 512 will not be performed. In other embodiments, no adjustment will be made to color values in the color lookup table if brightness introduced by backlight LEDs of the given color will be reduced by less than a predetermined amount or by less than a predetermined percentage of their maximum brightness level.

In method 500, while (at 514) there are more color histograms to be analyzed to identify any potential power reductions, operations 506-512 may be repeated, as applicable, for each of the other colors in the color model. For example, after performing some or all of operations 506-512 using information representing the red components of the pixel data, they may be repeated once using information representing the green components of the pixel data and again using information representing the blue components of the pixel data. If (at 516) it is determined that there are additional portions of the image frame represented in the pixel data for which backlighting is independently controlled, operations 504-514 may be repeated, as applicable, for each of the other portions of the image frame. For example, in embodiments in which different backlight controllers control the brightness of LEDs that backlight different portions of the image frame, operations 504-514 may be repeated, as applicable, to reduce the power consumed by the LEDs in each different portion of the image frame. Once all of the color information in the histograms for all of the colors has been analyzed to identify any potential power reductions and effect those power reductions, method 500 is complete for this image frame (518). In at least some embodiments, method 500 may be repeated for each image frame to be displayed by the display device.

As described herein, a display device may include a respective backlight controller for each color in a color model. A screen driver for the display device may produce a histogram of brightness values for each color in the pixel data for an image frame, and may reduce the brightness of backlighting elements of the display device for individual colors when the histogram data indicates that maximum brightness is not required. For example, based on a backlight control value or signal sent to the corresponding backlight controller, the intensity of backlighting elements for one color may be turned down, or even off, for a particular image frame while the backlighting elements for other colors remain fully powered. The screen driver may make an adjustment to the pixel data to compensate for the dimming of the backlighting elements by modifying the color values in a color lookup table. Preferentially dimming individual colors, as described herein, may significantly reduce the power consumption of an LCD display in an information handling system. This approach may also increase the battery life of portable information handling systems that include LCD displays.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A method for reducing power consumption in a display device, comprising:

receiving pixel data representing an image frame, the pixel data encoding colors of pixels in the image frame in accordance with a color model comprising a plurality of color components;

analyzing the pixel data, the analyzing including:

producing a respective histogram of brightness levels in the image frame for each of the color components of the color model; and determining, for each color component, a respective backlight control value based on the histogram for the color component;

sending, for each color component, the backlight control value for the color component to a respective backlight controller for the color component; and controlling, for each color component, intensity for each of a plurality of illuminating elements of the display device corresponding to the color component based on the backlight control value for the color component.

2. The method of claim 1, wherein the histogram for each color component indicates a minimum, maximum, or average brightness level for the color component in the pixel data.

3. The method of claim 1, wherein the plurality of illuminating backlight elements for each color component comprises one or more strings of light-emitting diodes (LEDs) that emit light having the color of the color component.

4. The method of claim 1, wherein the plurality of illuminating backlight elements for each color component comprises one or more strings of light-emitting diodes (LEDs) that backlight a subset of the image frame when displayed on the display device.

5. The method of claim 1, wherein:

the analyzing further includes determining a desired maximum brightness level for the color component in at least a portion of the image frame; and determining the backlight control value for the color component is dependent on the desired maximum brightness level.

6. The method of claim 1, wherein:

the analyzing further includes applying a mathematical or logical function to at least a portion of the brightness values in the histogram for the color component; and determining the backlight control value for the color component is dependent on results of the applying.

7. The method of claim 1, wherein:

for one of the color components, controlling the intensity for each of the plurality of illuminating elements of the display device corresponding to the color component includes reducing the brightness of the plurality of illuminating elements from a maximum brightness level; and the method further comprises:

determining an adjustment to be made to at least a portion of the color values in a color lookup table to compensate for reducing the brightness; and applying the adjustment to the color values in the color lookup table.

8. An article of manufacture comprising a non-transitory computer-readable medium storing instructions, that, when executed by a processor of a display device, cause the processor to:

access pixel data representing an image frame, the pixel data encoding colors of pixels in the image frame in accordance with a color model comprising a plurality of color components;

produce, based on the pixel data, a respective histogram of brightness levels in the image frame for each of the color components of the color model;

determine, for each color component, a respective backlight control value based on the histogram for the color component, the backlight control value to control the intensity for each of a plurality of illuminating elements of the display device; and send, for each color component, the backlight control value for the color component to a respective backlight controller for the color component.

9. The article of manufacture of claim 8, wherein the plurality of illuminating backlight elements for each color component comprises one or more strings of light-emitting diodes (LEDs) that emit light having the color of the color component.

10. The article of manufacture of claim 8, wherein the plurality of illuminating backlight elements for each color component comprises one or more strings of light-emitting diodes (LEDs) that backlight a subset of the image frame when displayed on the display device.

11. The article of manufacture of claim 8, wherein:

the instructions further include instructions to determine a desired maximum brightness level for the color component in at least a portion of the image frame; and the determination of the backlight control value for the color component is dependent on the desired maximum brightness level.

12. The article of manufacture of claim 8, wherein:

for one of the color components, the instructions further include instructions to apply a mathematical or logical function to at least a portion of the brightness values in the histogram for the color component; and the determination of the respective backlight control value for the color component is dependent on results of the application of the mathematical or logical function.

13. The article of manufacture of claim 8, wherein:

for one of the color components, the instructions to control the intensity for each of the plurality of illuminating elements of the display device corresponding to the color component include instructions to reduce the brightness of the plurality of illuminating elements from a maximum brightness level; and the instructions further include instructions to:

determine an adjustment to be made to at least a portion of the color values in a color lookup table to compensate for the reduction in brightness; and apply the adjustment to the color values in the color lookup table.

14. A screen driver, comprising:

a plurality of backlight controllers, each of which controls a respective collection of illuminating elements of a display device that emit light of the same given one of a plurality of colors of a color model; and a processor having access to a memory, wherein the memory stores instructions that, when executed by the processor, cause the processor to:

access pixel data representing an image frame, the pixel data encoding colors of pixels in the image frame in accordance with the color model;

produce, based on the pixel data, a respective histogram of brightness levels in the image frame for each color of the color model;

determine, for each color, a respective backlight control value based on the histogram for the color, the backlight control value to control the intensity for the collection of illuminating elements of a display device that emit light of the color; and send, for each color, the backlight control value for the color to a backlight controller that controls a collection of illuminating elements of a display device that emit light of the color.

15. The screen driver of claim 14, wherein the histogram for each color indicates a minimum, maximum, or average brightness level for the color in the pixel data.

16. The screen driver of claim 14, wherein the collection of illuminating elements that emit light of a given color comprises one or more strings of light-emitting diodes (LEDs) that emit light of the given color.

17. The screen driver of claim 14, wherein the collection of illuminating elements that emit light of a given color comprises one or more strings of light-emitting diodes (LEDs) that backlight a subset of the image frame when displayed on the display device.

18. The screen driver of claim 14, wherein:

for one of the colors, the instructions further include instructions to determine a desired maximum brightness level for the color in at least a portion of the image frame; and the determination of the backlight control value for the color is dependent on the desired maximum brightness level.

19. The screen driver of claim 14, wherein:

for one of the colors, the instructions further include instructions to apply a mathematical or logical function to at least a portion of the brightness values in the histogram for the color; and the determination of the backlight control value for the color is dependent on results of the application of the mathematical or logical function.

20. The screen driver of claim 14, wherein, for a given one of the colors, the instructions further include instructions to:

reduce the brightness of the plurality of illuminating elements that emit light of the given color from a maximum brightness level;

determine an adjustment to be made to at least a portion of the color values in a color lookup table to compensate for the reduction in brightness; and apply the adjustment to the color values in the color lookup table.

* * * * *